US005542351A

United States Patent [19]

Roth

[11] Patent Number: 5,542,351

[45] Date of Patent: Aug. 6, 1996

[54] METHOD FOR PRINTING DESIGNS ON PILE FABRICS

[76] Inventor: Leslie D. Roth, 70 Primrose, Laguna Hills, Calif. 92656

[21] Appl. No.: 314,366

[22] Filed: Sep. 28, 1994

[51] Int. Cl.[6] ..... B41M 1/12

[52] U.S. Cl. ..... 101/483; 101/35; 101/129; 8/445

[58] Field of Search ..... 8/445, 478, 486, 8/488, 495, 931, 932; 101/129, 483, 127, 35

[56] References Cited

U.S. PATENT DOCUMENTS

| | | | |
|---|---|---|---|
| 325,041 | 8/1885 | Bendick | 101/127 |
| 2,400,700 | 5/1946 | McCurrach | 101/127 |
| 3,918,895 | 11/1975 | Mizuno . | |
| 3,963,428 | 6/1976 | Stark . | |
| 4,085,700 | 4/1978 | Engels et al. . | |
| 4,173,452 | 11/1979 | Fleissner . | |
| 4,997,452 | 3/1991 | Kovach et al. . | |
| 5,298,031 | 3/1994 | Gabay et al. . | |

*Primary Examiner*—Christopher A. Bennett
*Attorney, Agent, or Firm*—Merchant, Gould, Smith, Edell, Welter & Schmidt

[57] ABSTRACT

An improved method of printing designs on pile fabrics. The finish on the fabric is removed by a washing process or other method. The lack of a finish on the fabric allows the ink maximum absorption. The design to be printed on the fabric is translated from a line drawing into a series of parallel line images oriented on a printing surface so that they are parallel to the pile of the fabric. The use of such parallel line images allows the inks to be placed inside or on top of the pile of fabric. The fabric may be printed using hand printing, automatic rotary printing, or application printing. The automatic rotary printing process is preferred as it gives maximum utility in that it provides an even ink distribution on the fabric and is typically the most economical way of printing. The method applies the inks or dye stuffs utilizing the weave of the fabric so that the ink or dye stuffs rest inside the pile. Due to the unfinished or washed nature of the fabric, there are no resins or finish on the fabric to repel the ink or dye stuffs. After printing, the design may be set using heat. A finish can be applied after the design is set, or the fabric can be left unfinished. or the fabric can be laundered.

16 Claims, 3 Drawing Sheets

METHOD FOR PRINTING DESIGNS ON PILE FABRICS

BACKGROUND OF THE INVENTION

1. Field of the Invention

This invention relates in general to a method for printing designs on pile fabrics.

2. Description of Related Art

Pile fabrics such as velvet, panne, and velour are usually knit or woven, and include a base and surface region defined by a dense pile formed of fibers. The pile is the area that is raised perpendicular to the woven or knitted backing. The fiber ends not attached to a base may not be erect and so the fibers may be laying down prior to the printing step, resulting in poor definition in the printing of designs on the fabric.

The printing of designs on fabrics such as velvet, panne or velour, has been accomplished in the past by using dye and discharge methods or by using heat transfer methods. Heat transfer methods are used with fabrics that contain synthetic fibers, and thus cannot be used with natural fibers. In dye and discharge methods, it is difficult to control the lines of the design because the colors tend to bleed or migrate when applied to the fabric's surface.

Thus, there is a need in the art for improved methods of printing on velvet, panne or velour fabrics.

SUMMARY OF THE INVENTION

To overcome limitations in the prior art described above, and to overcome other limitations that will become apparent upon reading and understanding the present specification, the present invention discloses a method of printing designs on velvet, panne or velour fabrics. The method begins with a velvet, panne or velour fabric that has either had its finish removed by a washing process or other method of removal, or the use of such fabrics that may have been dyed but not finished. The lack of a finish on the fabric allows the ink maximum absorption, whether it be metallic and/or matte ink. The next step of the method is the actual printing of the design. Beginning with a line drawing, a series of horizontal line images parallel to the pile of the fabric and comprising the pattern are generated manually or by computer. The use of such horizontal line images allows the inks to be placed inside and/or on top of the pile of fabric. The image is then translated to a screen for hand printing on the fabric, or translated to an engraving for automatic rotary printing on the fabric, or translated to an engraving for application printing on the fabric. The automatic rotary process is preferred as it gives maximum utility in that it provides an even ink distribution on the fabric and is typically the most economical way of printing. The method of the present invention applies the inks or dye stuffs utilizing the weave of the fabric so that the ink or dye stuffs rest inside or on top of the pile. Due to the unfinished or washed nature of the fabric, there are no resins or finish on the fabric to repel the inks or dye stuffs. The method can result in a monotone or multiple color print design. After printing, the design is set using heat and thereafter finishing may occur or the fabric left unfinished or the fabric may be laundered.

An object of the present invention is to improve the results of printing designs on fabrics such as velvet, panne or velour. An advantage of the present invention is that it is well suited to soft, drapey velvet and pile fabrics, although it may be used with other fabrics as well. Another advantage is that the present invention gives an inexpensive antique look to such fabrics and yet can be done economically. Still another advantage is that the fabrics themselves need little preparation and the process is easy to implement.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, references made to the accompanying drawings which form a part hereof, and in which is shown by way of illustration, a specific embodiment in which the invention may be practiced. It is to be understood that other embodiments may be utilized and changes may be made to the structural elements of the apparatus shown herein or the process steps described herein without departing from the scope of the present invention.

The present invention discloses a method of printing designs on velvet, panne or velour fabrics. The method begins with a velvet, panne or velour fabric that has either had its finish removed by a washing process or other method of removal, or the use of such fabrics that may have been dyed but not finished. The lack of a finish on the fabric allows the ink maximum absorption, whether it be metallic or matte ink. The next step of the method is the actual printing of the design. Beginning with a line drawing, a series of horizontal line images parallel to the pile of the fabric and comprising the pattern are generated manually or by computer. The use of such horizontal line images allows the inks or dye stuffs to be placed inside or on top of the pile of fabric. The image is then translated to a screen for hand printing on the fabric, or translated to an engraving of automatic rotary printing on the fabric, or translated to an engraving for application printing on the fabric. The automatic rotary process is preferred as it gives maximum utility in that it provides an even ink distribution on the fabric and is typically the most economical way of printing. The method of the present invention applies the inks or dye stuffs utilizing the weave of the fabric so that the ink or dye stuffs rest inside the pile. Due to the unfinished or washed nature of the fabric, there are no resins or finish on the fabric to repel the inks. The method can result in a monotone or multiple color print design. After printing, the design is set using heat and thereafter finishing may occur or the fabric left unfinished or the fabric may be laundered.

Figure 1:
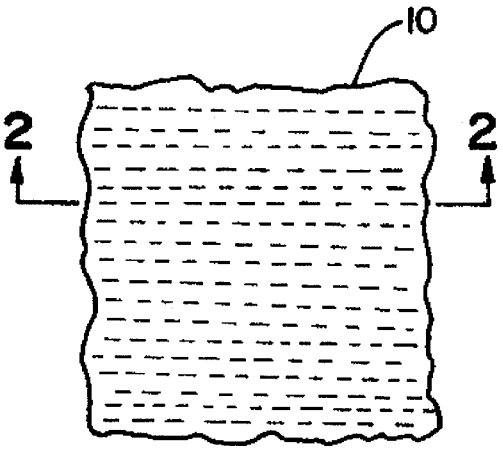
FIG. 1 is a schematic plan view of the pile fabric that has been printed with the design according to the method in the present invention.

FIG. 1 is a schematic plan view of a pile fabric 10 such as velvet, panne or velour, as used in the method of the present invention.

Figure 2:
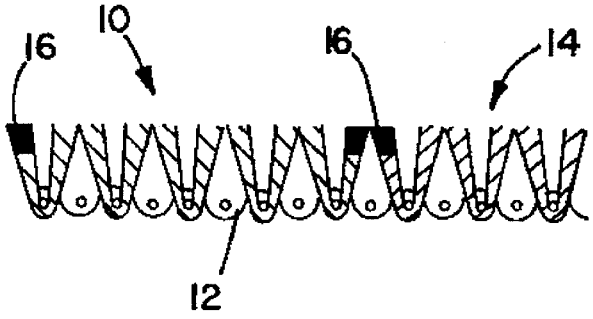
FIG. 2 is a fragmentary cross-sectional view taken along line 2—2 of the pile fabric of FIG. 1.

FIG. 2 is a fragmentary cross-sectional view taken along line 2—2 of the pile fabric of FIG. 1. This figure illustrates the structure of the pile fabric 10. The fabric 10 is typically knit or woven, and include a base 12 and surface region defined by a dense pile formed of fibers 14. The fibers 14 are raised perpendicular to the base 12. Printing results in ink or dye stuffs 16 being placed on the ends of the fibers 14.

Figure 3A:
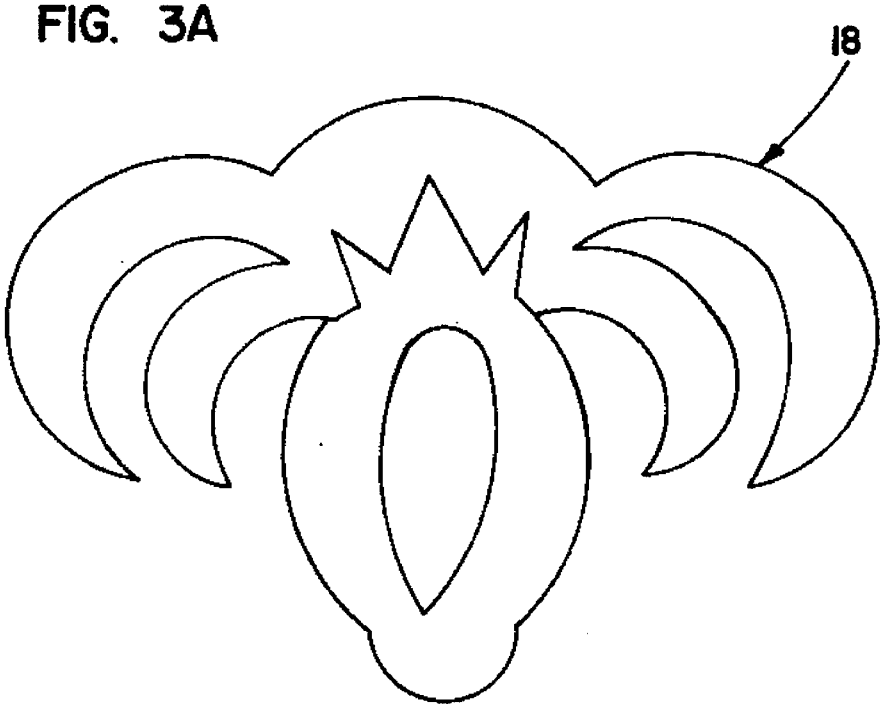
FIG. 3A shows an example line drawing for printing on a pile fabric and FIG. 3B shows the example line drawing translated into a series of parallel line images for the printing step according to the present invention.
Figure 3B:
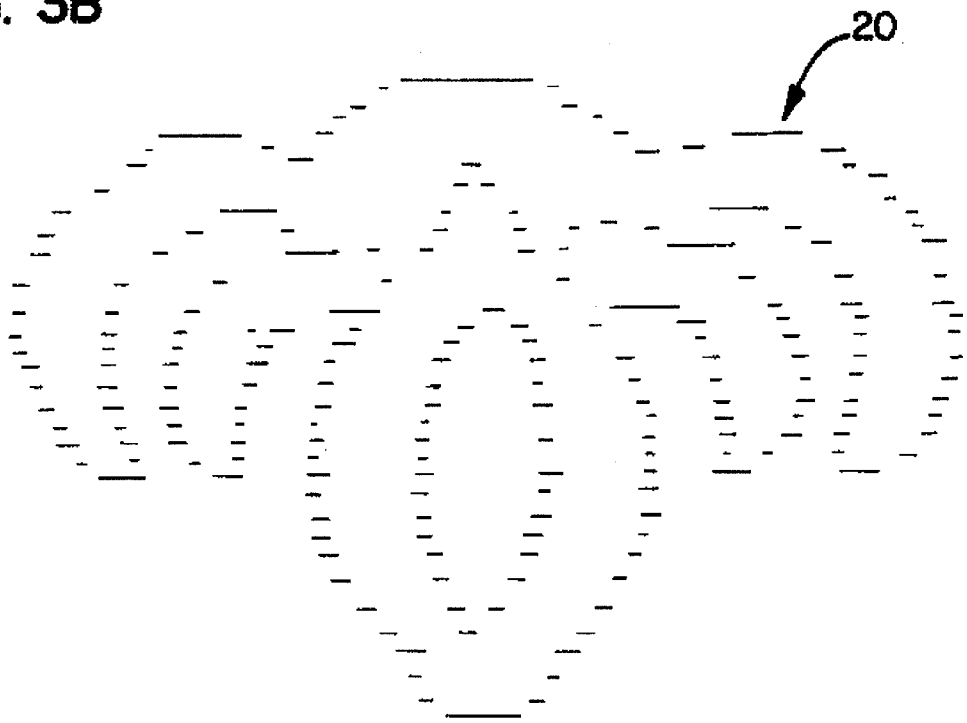

FIG. 3A shows an example line drawing 18 for printing on the pile fabric and FIG. 3B shows the example line drawing 18 translated into a series of parallel line images 20 for the printing step according to the present invention. Those skilled in the art will recognize that the example shown in FIG. 3B is for illustrative purposes only. The resolution of the translated parallel line images 20, including the number, length, and spacing of the lines, could differ from those shown in FIG. 3B without departing from the scope of the present invention.

Figure 4:
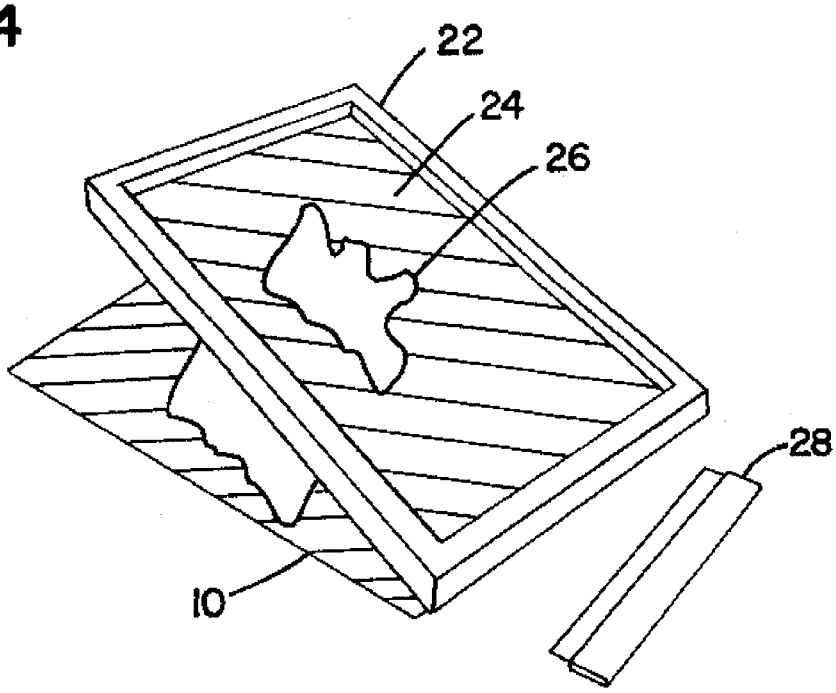
FIG. 4 is a schematic diagram of a hand silk screening apparatus utilizing the method of the present invention.

FIG. 4 illustrates an apparatus for hand silkscreen printing, which is typically used for specialty work. The apparatus includes a frame 22 surrounding a mesh screen 24. The area around the design or stencil 26 comprised of the horizontal line images 20 provides the stopping medium or resist that blocks out or masks an area of the screen 24. The stencil 26 is typically developed photochemically in a strong fine-mesh material, which in the past was typically comprised of silk, but is now almost wholly made of tougher material such as polyamide, polyester or metal. The screen 24 is laid on top of the fabric 10 to be printed, so that the horizonal line images 20 are parallel to the pile of the fabric 10. The inks or dye stuffs are forced across the screen 24 by a squeegee 28, so that the inks or dye stuffs pass through the unprotected areas of the screen 24 represented by the horizontal line images 20 to print directly onto the fabric 10. The use of horizontal line images 20 allows the inks or dye stuffs to be placed inside or on top of the pile of the fabric 10. Metallic and/or matte inks are used for printing on the fabric 10. The particular types of inks or dye stuffs employed in the printing process will depend on the type and density of fibers 14 employed in the fabric 10. The selection of such inks or dye stuffs are well known in the art and will not be described further herein. Because the fabric 10 is washed or untreated so it has no finish, the ink of dye stuffs achieve the maximum absorption and placement into the fabric 10. Moreover, the present invention eliminates the bleeding or dispersion found in other prior art methods.

Figure 5:
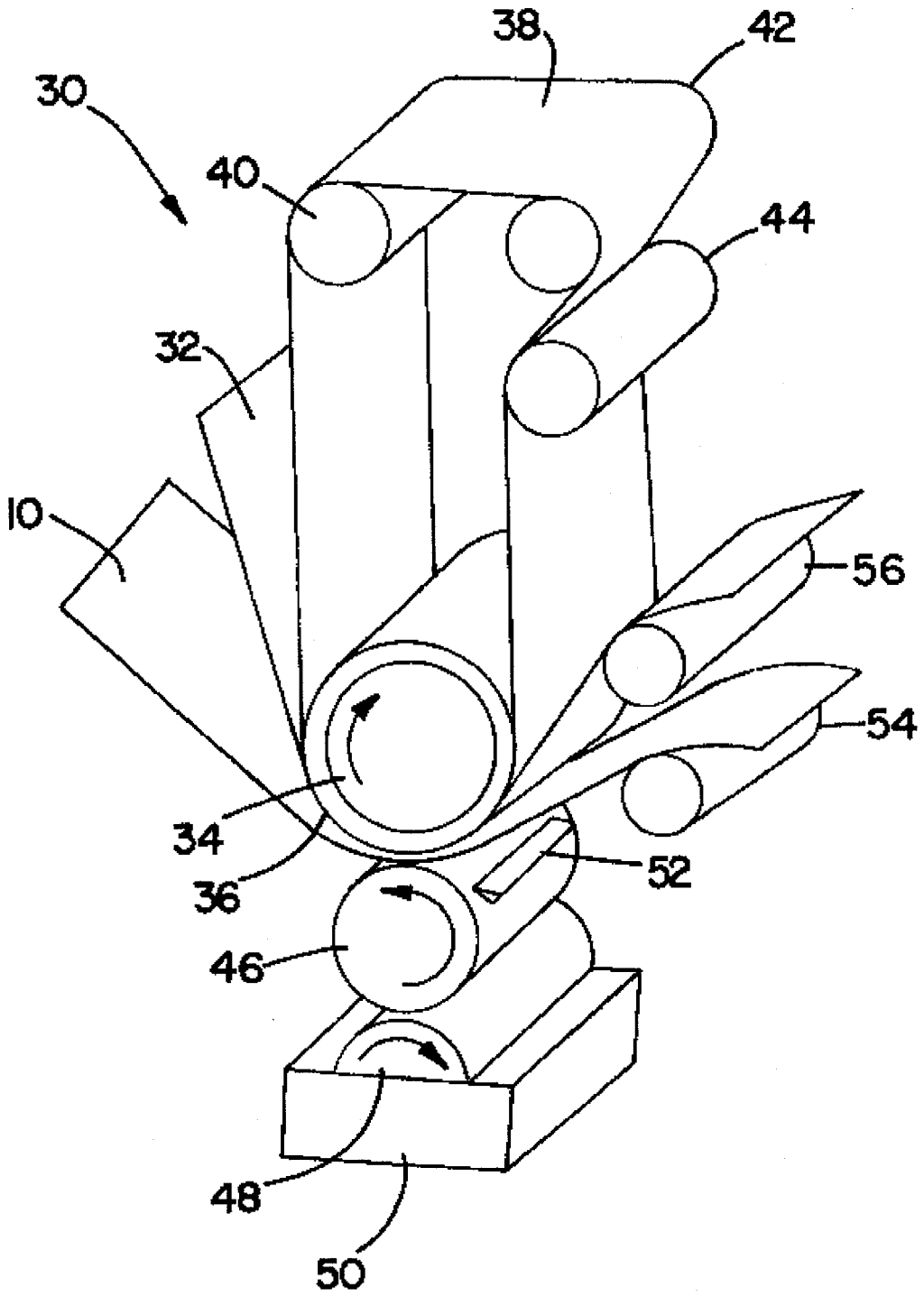
FIG. 5 is a schematic diagram of an automatic rotary apparatus utilizing the method of the present invention.

FIG. 5 illustrates an automatic rotary apparatus 30 utilizing the method according to the present invention. The fabric 10, along with a black-gray cotton backing 32, is pulled through the apparatus 30 by a pressure cylinder 34. The black-grey cotton backing 32 absorbs excess ink applied to the fabric 10 during the printing of the design. The pressure cylinder 34 is surrounded by fabric layers 36 for resilience and is driven by an endless thick blanket 38 that loops about guiding rollers 40, 42, and 44. Brushes (not shown) may be used to ensure that the fibers that make up the pile of fabric 10 are in an erect position for the printing process. A silkscreen or mesh screen containing the design or stencil surrounds a screen roller 46. Ink is supplied to the screen roller 46 by furnishing roller 48 that lies in a color box or trough 50. The fabric 10 passes between the pressure cylinder 34 and the screen roller 46. The line art that comprises the resist of the screen is thus transferred to the portion of the fabric 10 passing between the pressure cylinder 34 and the screen roller 46. The ink that passes through the screen is absorbed by the portion of the fabric 10 in contact with the pressure cylinder 34 and the screen roller 46. A doctor blade 52 is used to scrape off excess ink from the fabric 10. Thereafter, the fabric 10 passes across guiding roller 54 and the black-grey cotton fabric 32 passes across guiding roller 56 to exit the apparatus 30. The fabric 10 may also pass through an optional heating roller (not shown) or may be placed in a dryer (not shown) to set the design in the decorated fabric 10.

This concludes the description of the preferred embodiment of the invention. In summary, a method of printing on velvet, panne or velour fabrics has been described that enhances the transfer of ink or dye stuffs onto the fabric.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims intended hereto.

What is claimed is:

1. A method for printing on a fabric having a base and pile, comprising the steps of:

washing the fabric to remove any finish thereon;

translating a design including at least a curved portion into parallel line images formed on a printing surface, wherein the parallel line images are oriented on the printing surface in a manner parallel to the pile of the fabric to allow ink to be placed inside and on top of the pile of the fabric; and imprinting ink on the fabric using the printing surface.

2. The method of claim 1, wherein the printing surface is a stencil.

3. The method of claim 1, wherein the printing surface is an engraving.

4. The method of claim 1, wherein the imprinting step further comprises the step of applying the ink to the fabric utilizing a weave of the fabric so that the ink rests inside the pile of the fabric.

5. The method of claim 1, wherein the imprinting step further comprises the step of applying the ink to the fabric utilizing a weave of the fabric so that the ink rests on top of the pile of the fabric.

6. The method of claim 1, further comprising the step of finishing the fabric after the imprinting step.

7. A fabric printed by the method of claim 1.

8. A method for printing on a fabric having a base and pile, comprising the steps translating a design including at least a curved portion into horizontal line images formed on a printing surface, wherein the horizontal line images are oriented on the printing surface in a manner parallel to the pile of the fabric to allow ink to be placed inside and on top of the pile of fabric; and imprinting ink on the fabric using the printing surface.

9. The method of claim 8, wherein the fabric is unfinished.

10. The method of claim 8, further comprising the step of washing the fabric to remove any finish thereon prior to the imprinting step.

11. The method of claim 8, wherein the printing surface is a stencil.

12. The method of claim 8, wherein the printing surface is an engraving.

13. The method of claim 8, wherein the imprinting step further comprises the step of applying the ink to the fabric utilizing a weave of the fabric so that the ink rests inside the pile of the fabric.

14. The method of claim 8, wherein the imprinting step further comprises the step of applying the ink to the fabric utilizing a weave of the fabric so that the ink rests on top of the pile of the fabric.

15. The method of claim 8, further comprising the step of finishing the fabric after the imprinting step.

16. A fabric printed by the method of claim 8.

* * * * *

UNITED STATES PATENT AND TRADEMARK OFFICE
CERTIFICATE OF CORRECTION

PATENT NO. : 5,542,351

DATED : August 6, 1996

INVENTOR(S) : Leslie D. Roth

It is certified that error appears in the above-identified patent and that said Letters Patent is hereby corrected as shown below:

Column 4, line 55, after "steps" insert --of:--.

Signed and Sealed this

Thirty-first Day of December, 1996

*Attest:*

*Attesting Officer*

BRUCE LEHMAN

*Commissioner of Patents and Trademarks*